United States Patent [19]

Patterson

[11] Patent Number: 4,688,545

[45] Date of Patent: Aug. 25, 1987

[54] STOVE

[76] Inventor: Tom W. Patterson, P.O. Box 65, Hayesville, Ohio 44838

[21] Appl. No.: 895,592

[22] Filed: Aug. 14, 1986

Related U.S. Application Data

[63] Continuation of Ser. No. 761,042, Jul. 31, 1985, abandoned.

[51] Int. Cl.[4] ..... F24C 1/14

[52] U.S. Cl. ..... 126/77; 126/61; 126/112; 126/136; 126/289; 126/193; 110/203

[58] Field of Search ..... 126/76, 77, 65, 66, 126/198, 136, 300, 285 B, 289, 193, 146, 80; 110/203, 175 R

[56] References Cited

U.S. PATENT DOCUMENTS

| | | | |
|---|---|---|---|
| 2,750,936 | 6/1956 | Saito | 126/290 |
| 4,184,473 | 1/1980 | McIntire et al. | 126/136 |
| 4,200,086 | 4/1980 | Kolb | 126/77 |
| 4,201,187 | 5/1980 | Skow | 126/112 |
| 4,265,214 | 5/1981 | Rasmussen | 126/112 |
| 4,319,556 | 3/1982 | Schwartz et al. | 126/77 |
| 4,328,784 | 5/1982 | Cox | 126/61 |
| 4,330,503 | 5/1982 | Allaire et al. | 126/289 |
| 4,377,153 | 3/1983 | Flagg | 126/77 |
| 4,392,477 | 7/1983 | Milligan | 126/77 |
| 4,404,953 | 9/1983 | Thulman et al. | 126/77 |
| 4,411,385 | 10/1983 | Lamkewitz | 237/2 A |
| 4,432,335 | 2/1984 | Kilham | 126/77 |
| 4,469,083 | 9/1984 | Helle et al. | 126/77 |
| 4,483,312 | 11/1984 | Martenson | 126/77 |

*Primary Examiner*—James C. Yeung

*Attorney, Agent, or Firm*—Oldham, Oldham, & Weber Co.

[57] ABSTRACT

Stove for burning solid fuels, particularly wood. The stove has a pedestal which has a primary air inlet and an ash drawer; an upright rectangular main housing which is divided internally into a fire box section and a section for combustion products; a housing for electrical components on the back of the main housing; and a flue. The partition between the fire box and the top portion has a first passageway with a catalyst therein and a damper-controlled bypass passageway. Primary air is admitted beneath the grate and passes upwardly therethrough. Secondary air is admitted to the fire box near the glass-panelled charging doors for solid fuel. The stove has a catalyst chamber for completing combustion of the incompletely burned gases in the fire box. A substantially uniform fire box temperature and fuel combustion rate are maintained, regardless of the amount of fuel in the stove (unless fuel is nearly out) by means of a thermocouple in the fire box and an electronic control instrument which controls a valve for admission of primary air. Secondary air is admitted full time although the rate can be varied.

9 Claims, 17 Drawing Figures

STOVE

This application is a continuation of application Ser. No. 761,042, filed July 31, 1985, abandoned.

TECHNICAL FIELD

This invention relates to stoves for burning solid fuels and particularly to wood burning stoves.

BACKGROUND ART

Wood burning stoves have become increasingly popular in recent years. Such stoves have proved to be practical for heating individual rooms, small homes, mobile homes, and other structures. In many areas wood is available at a far lower cost than conventional fossil fuels such as oil and gas, and wood stoves have proved to be particularly popular in those areas.

The wood stoves which are presently available have certain disadvantages. A major disadvantage is that wood stoves do not maintain as even a temperature as do furnaces burning other fuels. Another disadvantage is that combustion is incomplete in a typical wood stove. As a result creosote and other pollutants pass unburned through the stove and are discharged into the atmosphere. A third disadvantage is that some of the products of incomplete combustion, notably creosote, collect in the chimney where they constitute a fire hazard.

There exists a need for a wood burning stove which has the attributes of safety, evenness of heat output regardless of the amount of fuel present, and freedom from air pollution. These attributes are taken for granted in large furnaces which burn coal, oil or gas, but have not been attained heretofore in wood stoves.

DISCLOSURE OF INVENTION

It is an object of this invention to provide a safe wood burning stove.

It is a further object of this invention to provide a wood burning stove in which a minimum of pollutants are discharged into the atmosphere.

It is a further object of this invention to provide a wood burning stove in which a minimum of combustible constituents and particularly creostote collect in the chimney.

It is an object of this invention to provide a wood burning stove having a high combustion efficiency.

A still further object of this invention is to provide a wood burning stove having substantially uniform heat output.

A still further object of this invention is to provide a wood stove which will burn either wood or other solid fuel while attaining the above objects.

Briefly, the present invention provides a stove for burning solid fuels comprising a fire box having a grate and opening means for discharging exhaust gases near the bottom thereof; means for admitting primary air below the grate and passing the primary air upwardly through the grate; means for admitting secondary air to the firebox; an air space above and behind the fire box, and blower means for circulating air therein. The preferred stove of this invention also includes temperature responsive means for controlling the admission of primary air.

According to a preferred embodiment of the invention, the fire box has two openings in its top wall, the first having a catalyst therein, the second being controlled by a damper.

BEST MODE FOR CARRYING OUT INVENTION

This invention will be described with particular reference to wood burning stoves. However, it is to be understood that the stove described herein can burn other solid fuels, notably anthracite and bituminous coal, with good results.

Figure 1:
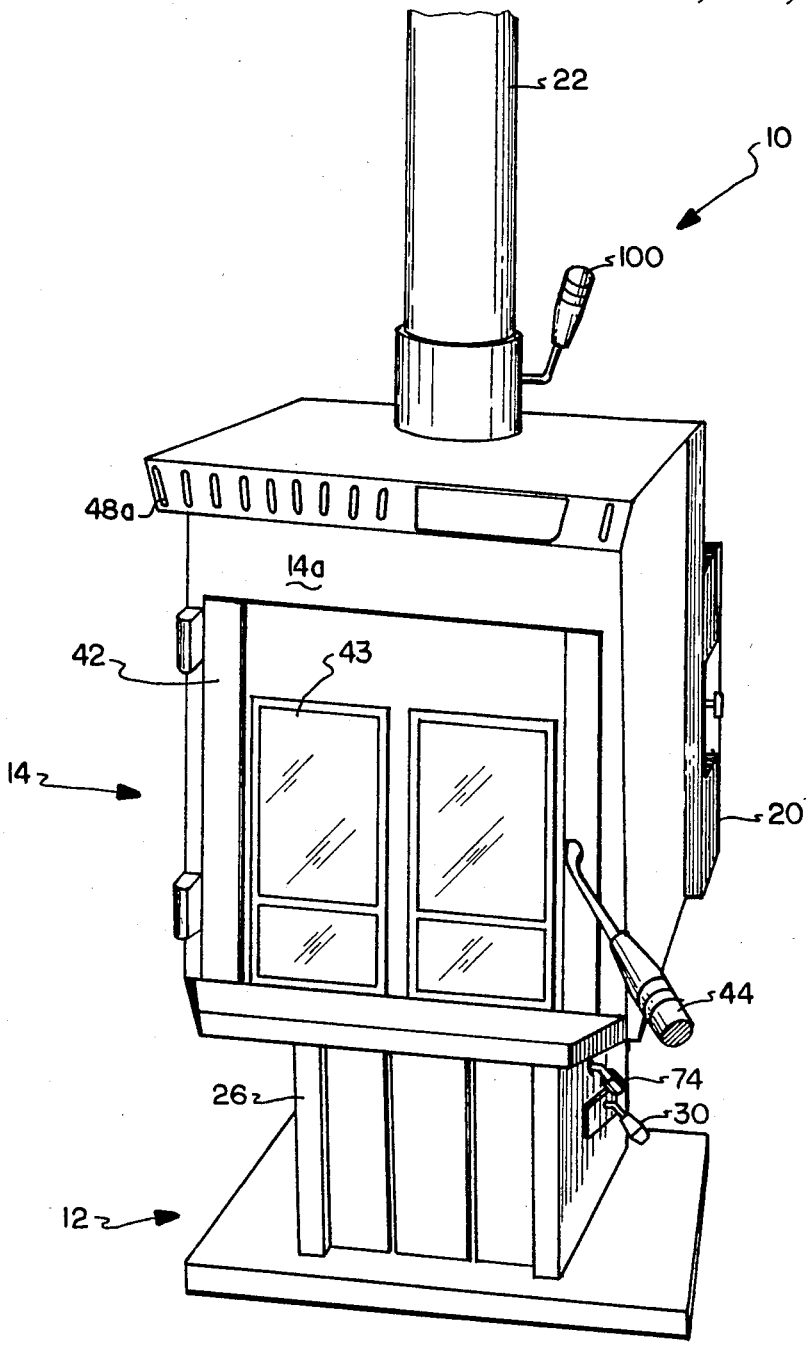
FIG. 1 is a perspective view of the stove according to a preferred embodiment of this invention.
Figure 3C:
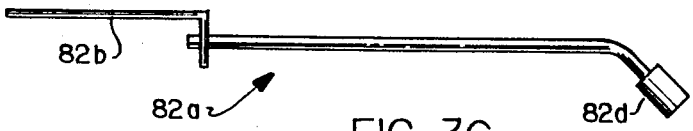
FIGS. 3C and 3D are a side view and a plan view, respectively, of the manually operated secondary air valve.
Figure 3D:
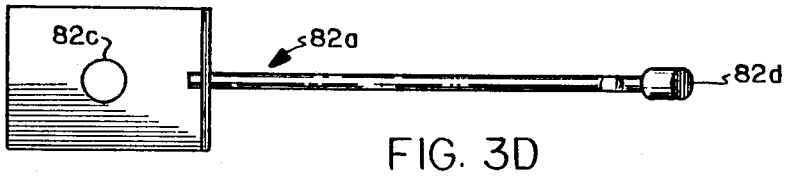
Figure 1A:
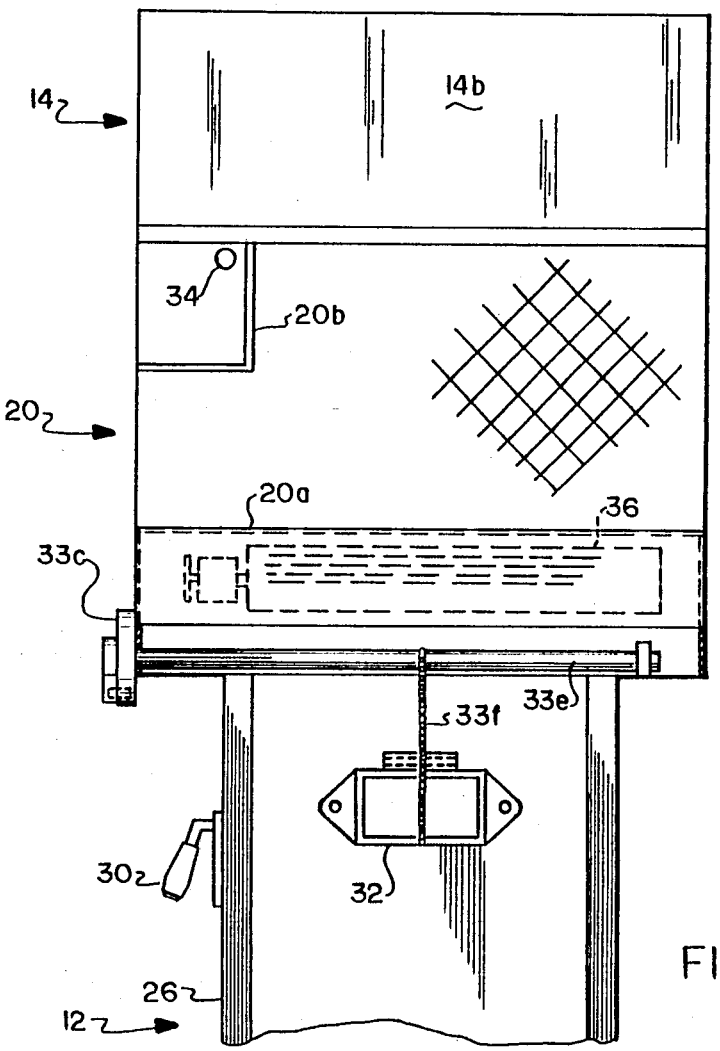
FIG. 1A is a back elevational view according to the preferred embodiment of the invention.
Figure 10:
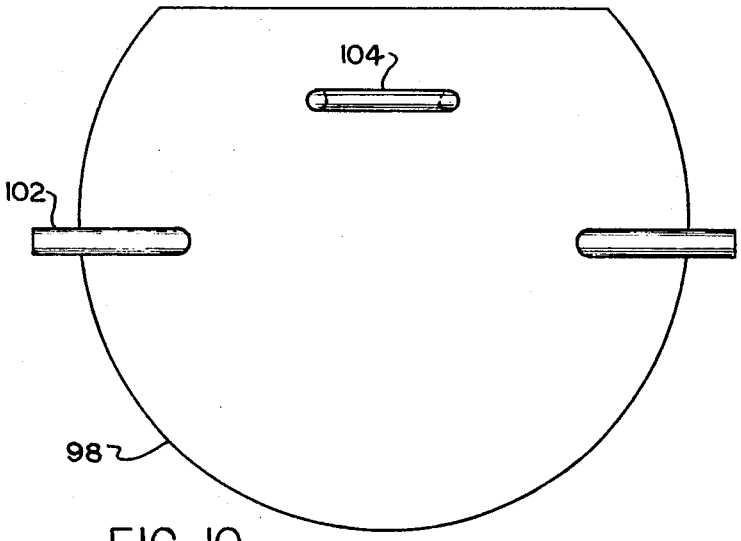
FIG. 10 is a plan view of the bypass damper.

Referring now to FIGS. 1 and 1A, 10 indicates generally a solid fuel burning stove according to this invention. Stove 10 comprises a pedestal 12, an upright main housing 14 which encloses a fire boxe 16 and an air space 18 (shown in FIG. 2) above and behind the fire box for circulating air, a blower housing 20 which is bolted to the back of main housing 14 behind the fire box 16, and a flue 22. Heat from fire box 16 heats the circulating air in air space 18.

Main housing 14 has front and back walls **14*a* and 14*b*, respectively, and side walls 14*c*. Blower housing has a vertical outer wall 20*a*, which is at the back of the stove 10. Back wall 14*b* divides main housing 14 from blower housing 20** and is shared by the two housings.

Blower housing 20 serves as the housing for all electrical components. The blower housing 20 is divided into compartments, including a blower compartment **20*a* which houses a blower 36 for circulating air through space 18, and a compartment 20***b* for a thermocouple 34 and other electrical controls. The electrical component may be powered by a standard 110 volt AC electric line, and a cord and plug (not shown) for connection to such line may extend from compartment 20*b*.

Pedestal 12 includes a rectangular base 24 and an upright columnar structure 26 of rectangular cross section. Pedestal 12 includes an ash pan drawer 28 which opens from the side, and handle 30 for opening and closing the ash pan drawer.

Figure 2:
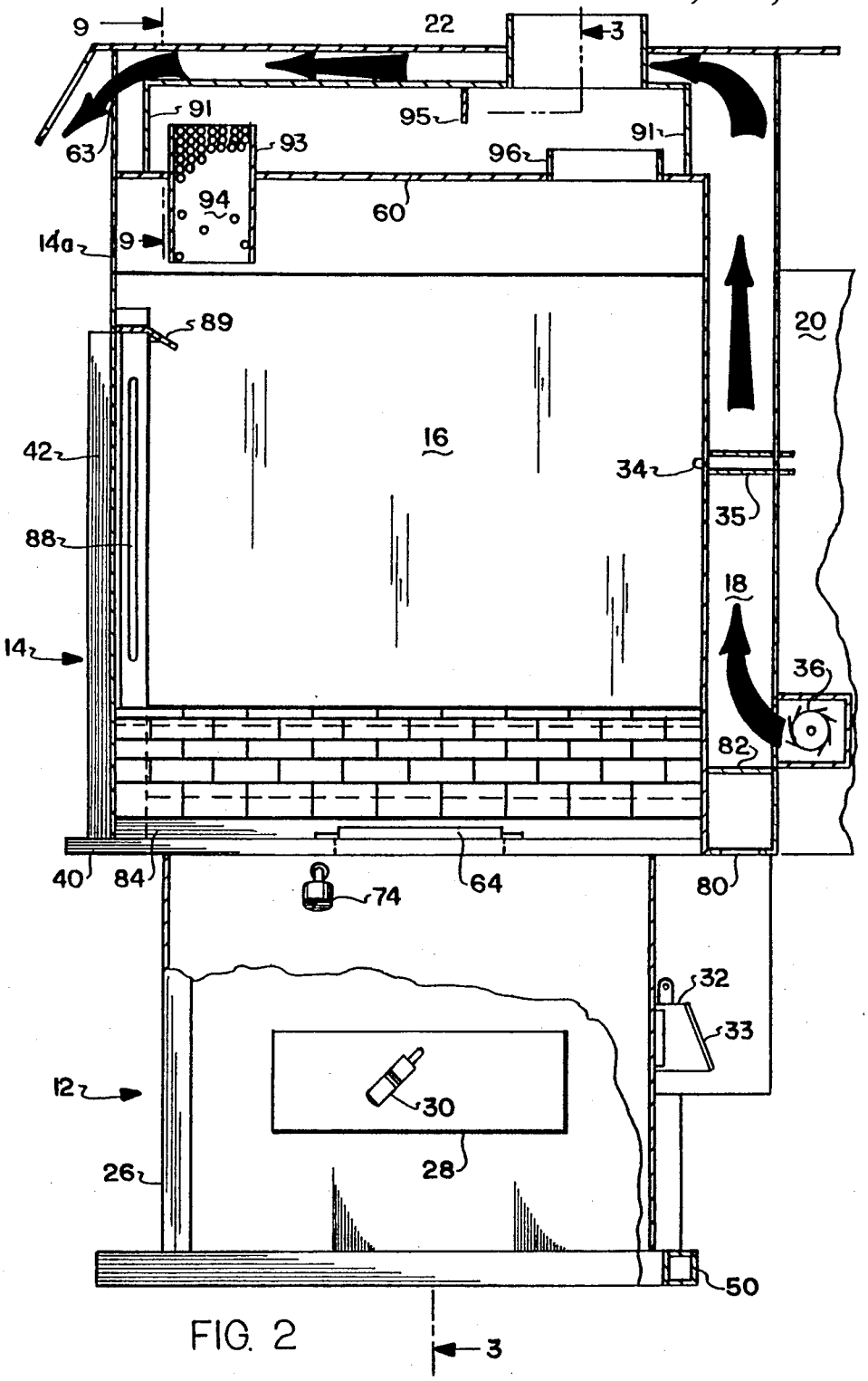
FIG. 2 is a side view, partly in elevation and partly in section taken along line 2—2 of FIG. 3.
Figure 3:
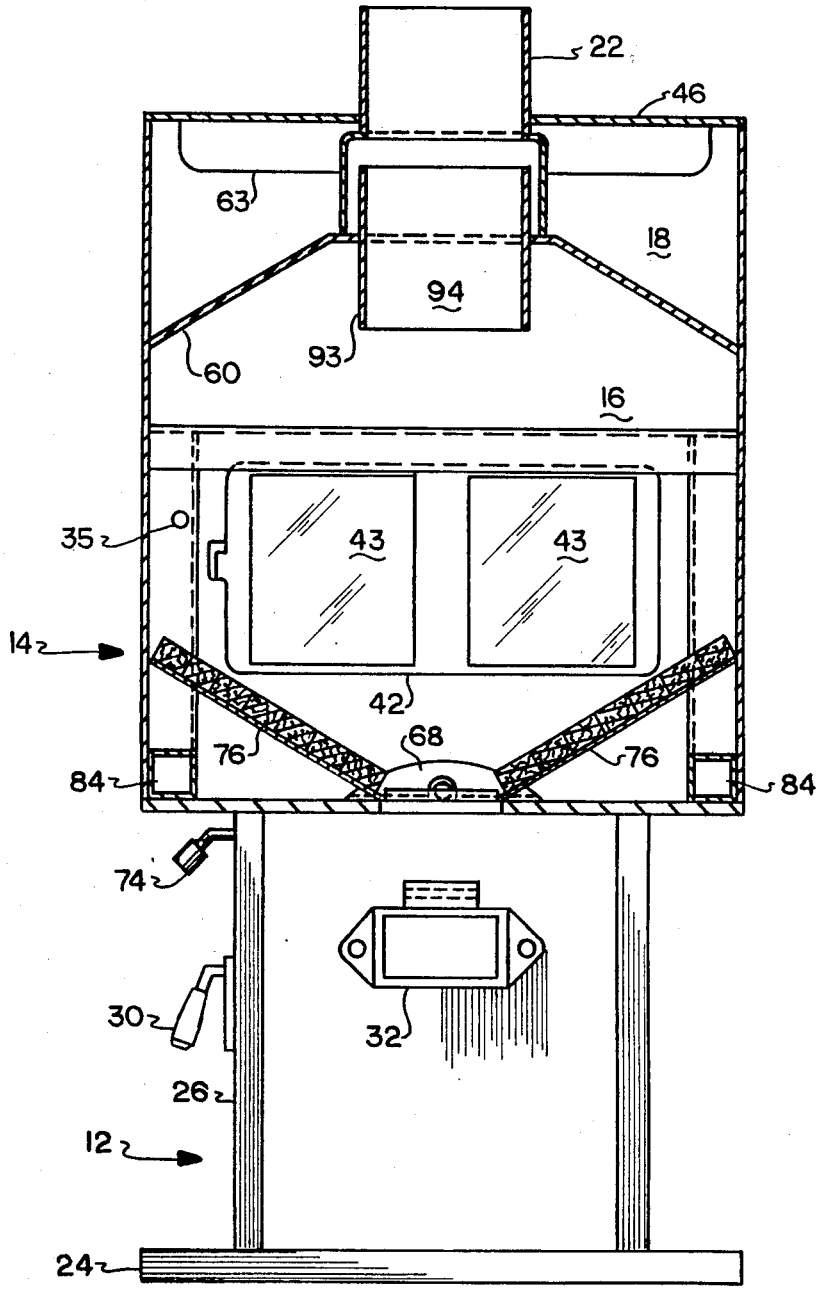
FIG. 3 is a back view, partly in elevation and partly in section taken along line 3—3 of FIG. 2, with the bypass damper for combustion gases and the handle therefor removed.
Figure 3A:
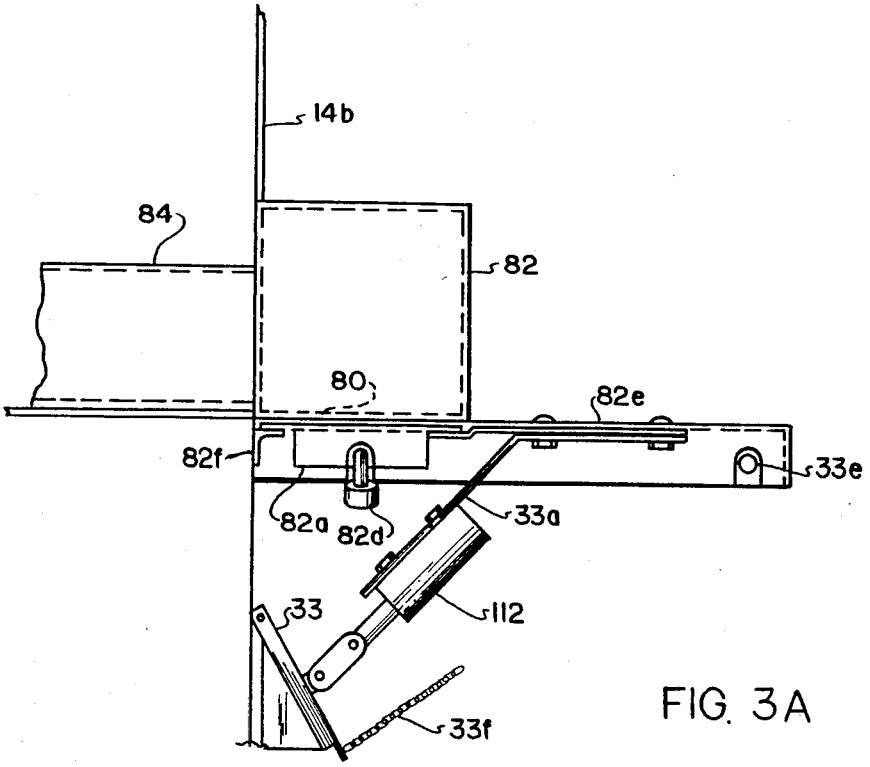
FIG. 3A is a side view of the primary air and secondary air inlet controls, with the cover removed.
Figure 3B:
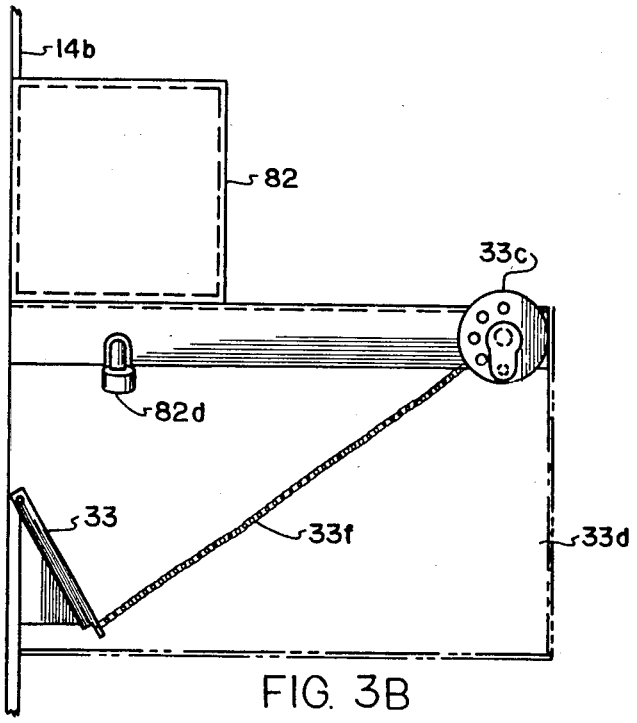
FIG. 3B is a side view, from the same vantage point as FIG. 3A but with the cover in place, showing the manual override control for primary air.

Stove 10 will now be described in further detail with reference to FIGS. 2 and 3. Disposed on the back of pedestal 12, as shown in FIGS. 2 and 3, is the primary air intake 32 for the stove. Admission of air via the primary air intake 32 is controlled by a pivoted valve 33 (FIG. 2) which may be controlled either by a solenoid or manually. A thermocouple 34 (FIG. 2), which extends through tube 35 from blower housing 20 into the firebox 16, controls the operation of the solenoid in a manner which will be described in more detail later. The manual valve will also be described later.

A blower 36 in blower housing 20 provides for forced circulation of air through air space 18. Blower 36 is a continuously variable speed motor. The speed of the blower 36 may be controlled by blower speed control 37, which is mounted on the exterior of blower housing 20. A blower thermostat 38, mounted on the back wall 14*b* of main housing 14, senses the wall temperature, which in turn is determined by the air temperature in air space 18, and shuts off blower 36 when the air temperature falls below a predetermined level. Bolts (not shown) secure the blower housing 20 to the main housing 14.

The main housing 14 has a floor 40, which is also the floor of fire box 16, and a charging door 42 in front wall 14*a* for charging wood and other solid fuel to the fire box. Charging door 42 is air tight and has panels 43 of a high temperature glass such as "Pyroceran" manufactured by Corning. Charging door 42 may be opened and closed by means of handle 44. The top of housing 14 is closed by means of an airtight roof 46. Roof 46 is essentially horizontal with a downwardly sloping from portion 48. Front portion 48 may have slots 48*a* and a nameplate 48*b*.

Stove 10 is constructed of high-durability, heavy-gauge steel throughout, except for the handles (which are wood), glass panels 43 in charging door 42, or except as otherwise specifically described.

Pedestal floor 24 is made of heavy gauge sheet steel with square tubes 50 extending around the perimeter thereof for structural support. The ash drawer 28 may be supported by suitable means (not shown).

The interior of housing 14 is divided by a horizontally extending metal partition 60 and a vertical metal wall 62 into a firebox 16 and an air space 18 which is above and behind the firebox 16. Metal partition 60 and wall 62 form the top wall and the back wall, respectively of firebox 16. Partition 60 extends from the front wall 14*a* of housing 14 to back wall 62. Partition 60 has three sections, a horizontal center section and two side sections, which slope downwardly at an angle of 30 degrees from the center section to the side walls 14*c* of 14. Gas tight welds join the partition 60 to walls 14*a*, 14*c* and 62.

The air space 18 between walls 62 and 14*b* behind firebox 16, and between partition 60 and roof 46, provides for heating and circulation of air. Air drawn in from the room in which the stove is located circulates through this air space and is heated by heat from the firebox 16. Heated air is discharged into the room through an opening 63 in front wall 14*a* of housing 14. Arrows indicate the direction of air flow.

Figure 4:
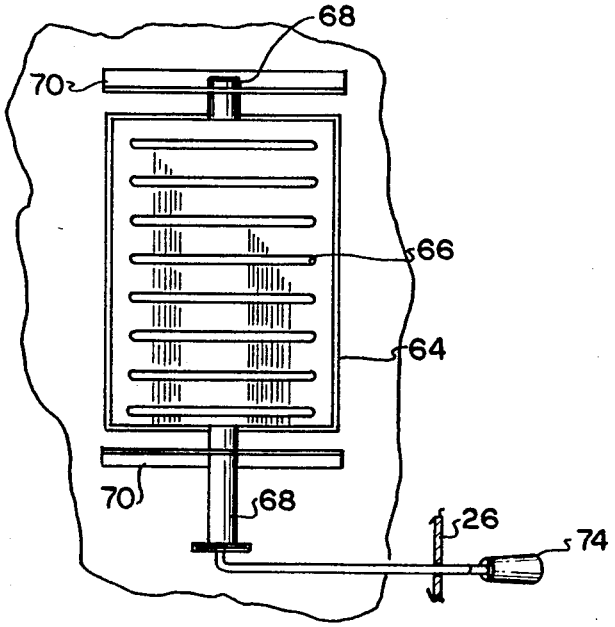
FIG. 4 is a detail top plan view of the rocker grate and rocker handle.
Figure 5:
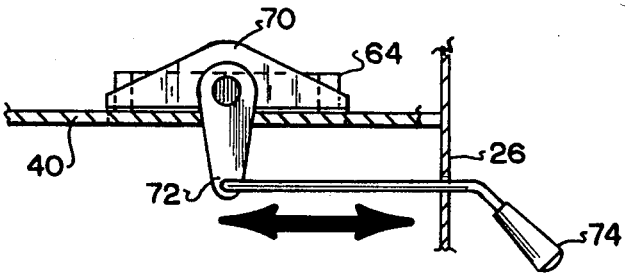
FIG. 5 is a detail side elevational view, with parts in section, of the rocker grate and rocker handle.

At the bottom of firebox 18, and supported on floor 40, is a rectangular cast iron rocker grate 64. Floor 40 has a rectangular opening, just slightly larger than grate 64, for the grate. Details of the grate may be seen in FIGS. 4 and 5. As best seen in FIG. 4, grate 64 is a cast iron structure with a plurality of transverse slots 66 to permit primary air to pass therethrough, and a pair of trunnions 68 at the ends thereof. Trunnions 68 are received in round holes in brackets 70 which are affixed to floor 40. Fixedly secured to one of the trunnions 68 is a link 72 which has a hole therein to received handle 74, which extends to the exterior of the stove. By pushing or pulling the handle 74, one rocks the grate 64, causing ash to drop into the ash drawer 28. The double arrow in FIG. 5 indicates the motion of handle 74.

A pair of fire brick lined channels 76 extend upwardly at the sides of grate 64 at an angle of 30 degrees from the horizontal, as best seen in FIG. 4. All horizontal surfaces in firebox 16 (i.e., in front of and behind grate 64), and the vertical wall 14*b* up to the height at which channels 76 intersect side walls 14*c*, are also fire brick lined. Channels 76, together with grate 64, support the wood or other solid fuel in the fire box.

Figure 6:
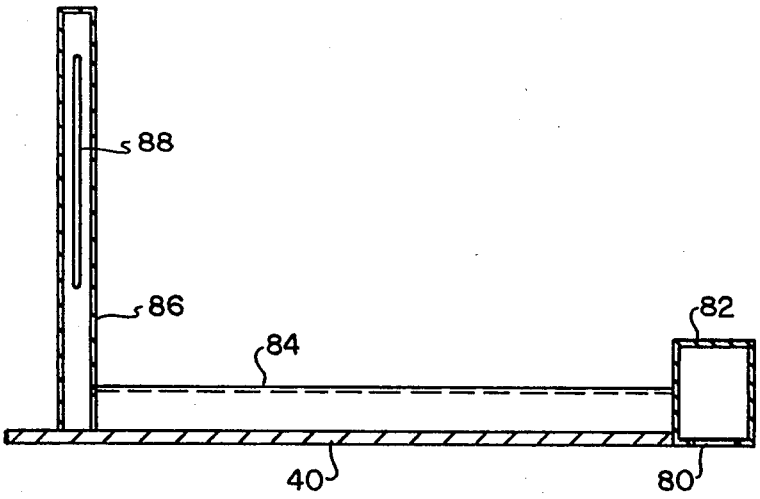
FIG. 6 is a front elevational view of the rocker grate and rocker handle with parts in section.

The flow of secondary air will now be described with reference to FIGS. 2, 3 and 6. As shown in FIGS. 2, 3 and 6, secondary air is admitted to the stove at a secondary air intake 80 in the bottom of blower housing 20 midway between the two sides of the stove. Secondary air flows through intake 80 into a horizontal tubular duct 82 of square cross section which runs behind the back wall 62 of firebox 16 from one side of the stove to the other. This duct 82 communicates with two horizontal branch ducts 84 which extend along either side of stove 10 from the back to the front thereof. These two horizontal ducts 84 in turn communicate with vertical ducts 86 which extend upwardly inside housing 14 at the two front corners thereof. These vertical ducts extend up to the top of charging door 42. Vertical ducts 86 have vertical slots 88 therein for discharge of secondary air into the firebox. These slots are so positioned that secondary air is directed against the glass panels of charging door 42, thereby aiding in keeping these glass panels clean. The secondary air also serves as an oxygen source for more complete combustion of any unburned gaseous products that are in firebox 16. A baffle 89 which has both a horizontal portion and a downturned portion aids in directing the secondary air against the glass panels.

The flow rate of secondary air can be varied over a wide range by varying the size of the secondary air inlet opening 80. Typically the maximum opening is at least twice as large as the minimum opening. However, secondary air cannot be shut off entirely. This is important because secondary air constitutes the sole source of combustion air when primary air intake valve 33 is closed.

The secondary air inlet control will now be described with reference to FIGS. 3A to 3D. Referring to FIGS. 3A to 3D, a slide valve 82*a* having a closure member 82*b* with a hole 82*c* therethrough and a handle 82*d*, controls the flow of secondary air through inlet opening 80. When slide valve 82*a* is pushed in, closure member 82*b* is out of register with opening 80 so that this opening is fully open. (This is the position of slide valve 82*a* during startup). When slide valve 82*a* is pulled out, closure member 82*b* and opening 82*c* are aligned with opening 80, restricting the flow of secondary air. (This is the position during normal operation). Thus, secondary air valve 82*a* is open at all times, but one position (in) provides a larger air opening than the other (out). Slide valve 82*a* is supported from plate 82*e* (FIG. 3A) which is welded to the bottom of duct 82. An angle 82*f* welded to plate 82*e* and to pedestal 12 gives plate 82*e* additional support.

Solenoid 112 (FIG. 3A) controls the operation of primary air intake valve 33. Solenoid 112 is mounted on angle plate 33*a*, which is bolted to plate 82*e*. Solenoid 112 has two positions, open and closed. Thermocouple 34 controls the position of solenoid 112. Solenoid 112 and thermocouple 34 are omitted in stoves not equipped with microprocessor control (to be described later).

Also supported on plate 82*e* is a manual control for primary air valve 33. The manual control includes a control knob 33*c* (FIG. 3B) which has a plurality of positions ranging from full closed to full open. This knob is mounted on the exterior of cover 33*d*, which covers the air controls. Knob 33*c* turns a rod 33*e* (FIGS. 1A and 3B), which controls the movement of a chain 33*f*, which controls the opening and closing of primary air valve 33. The manual control is the sole control of primary air valve 33 in stoves not equipped with a microprocessor; it serves as a manual override for the solenoid 33*a* in stoves equipped with a microprocessor.

Welded to the top side of partition 60 is an inverted channel 90 which extends from near the front wall 14*a* of housing to near the back wall 62 of firebox 16. Vertical end walls 91 at either end of channel 90 are welded to channel 90 and partition 60 to form a gas tight space 92 for hot combustion gases. These hot combustion gases warm air flowing in passageway 18 by indirect heat exchange between the two streams. Air flowing in passagway 18 also receives heat from firebox 16 as previously mentioned.

Figure 8:
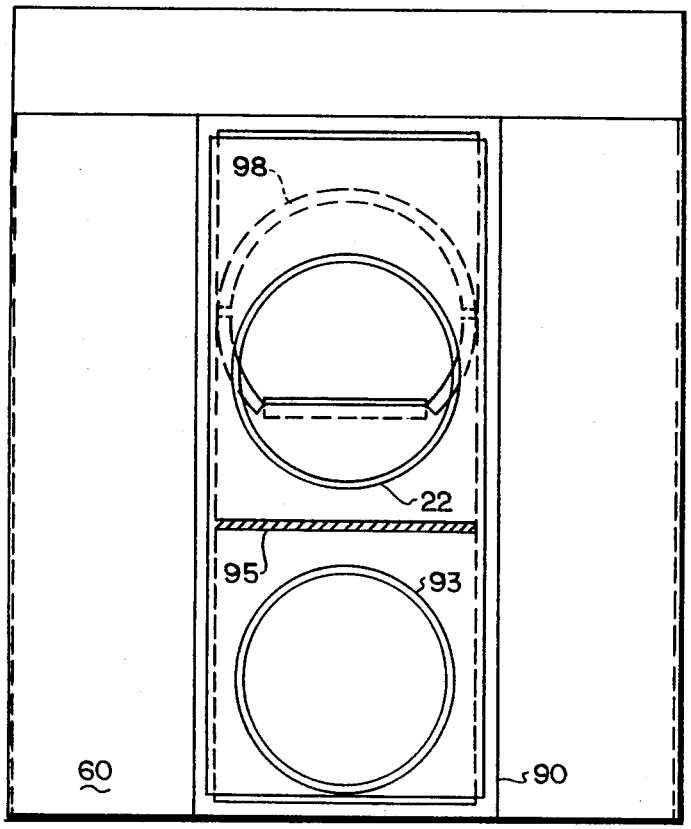
FIG. 8 is a top plan view of the top wall of the firebox showing the catalyst chamber and bypass opening in the wall.
Figure 9:
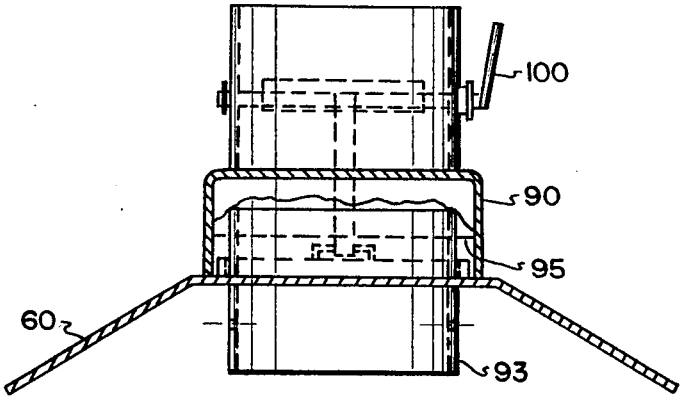
FIG. 9 is a vertical sectional view taken along line 9—9 of FIG. 2 of the firebox top wall the channel thereabove which forms a combustion exit gas chamber.

Horizontal partition 60 has two openings for discharge of combustion or flue gas into space 92. Partition 60 and the openings therein are shown in FIGS. 2 and 3, and on a larger scale in FIGS. 8 and 9. A round vertical pipe 93 which houses catalyst chamber 94 (FIG. 2) is disposed in the first of these openings. Catalyst chamber 94 is near the front of the stove for maximum effectiveness. (The catalyst chamber should be near the location where secondary air is admitted.) Catalyst chamber 94 contains a bed of oxidation catalyst. Pipe 93 is welded to the partition 60 and extends a short distance on either side thereof. A screen at the bottom of this pipe supports the catalyst in catalyst chamber 94. The catalyst may be a known oxidation catalyst comprising a metal or metal oxide on a ceramic support. This catalyst is extremely valuable in bringing about substantially complete combustion of any unburned or combustible gases in the firebox, even at low firebox temperatures. The catalyst may be omitted; however, removal of combustibles is much more nearly complete, especially at low firebox temperatures, if the catalyst is present.

A baffle 95 extending downwardly from the roof of housing 14 increases turbulence in the hot flue gas stream in flue gas space 92, and improves heat exchange efficiency between the flue gas stream and the air stream in space 18.

Figure 7:
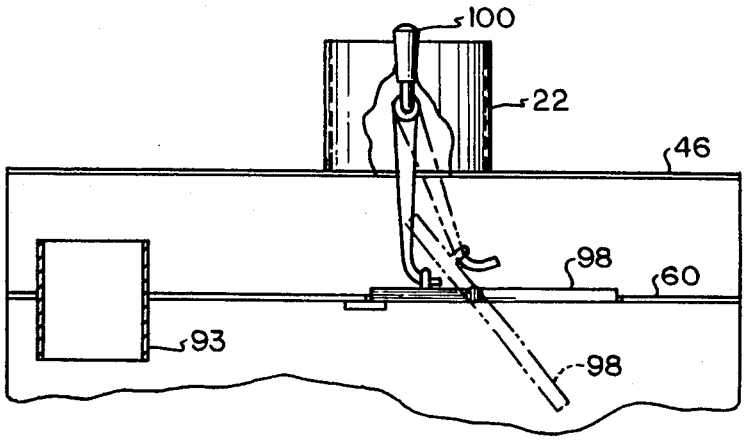
FIG. 7 is a side elevational view, with parts in section, of the bypass damper and handle for operating the same.

A second opening in partition 60 is a valve-controlled bypass opening 96. The valve, shown in FIGS. 7 and 9 but omitted in FIG. 2 for the sake of clarity, is a damper 98 which may be manually opened and closed by means of a handle 100 located above the top of stove 10. The motion of damper 98 is best seen in FIG. 7, in which the closed position thereof is shown in solid lines and the open position in dotted lines.

Figure 11:
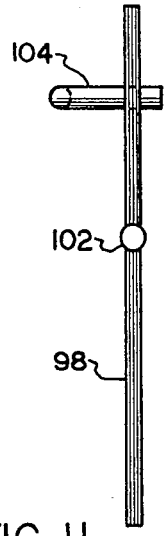
FIG. 11 is a side elevational view of the bypass damper.

Details of damper 98 are best seen in FIGS. 10 and 11. Damper 98 is in the form of a plate. Damper 98 has pins 102 welded thereto and a hook 104 extending upwardly therefrom. Hook 104 is linked to the lever mechanism controlled by handle 100. Movement of handle 100 causes damper 98 to rotate about an axis which extends through pins 102. Pins 102 rotate in journals provided on top of the partition 60.

Figure 12:
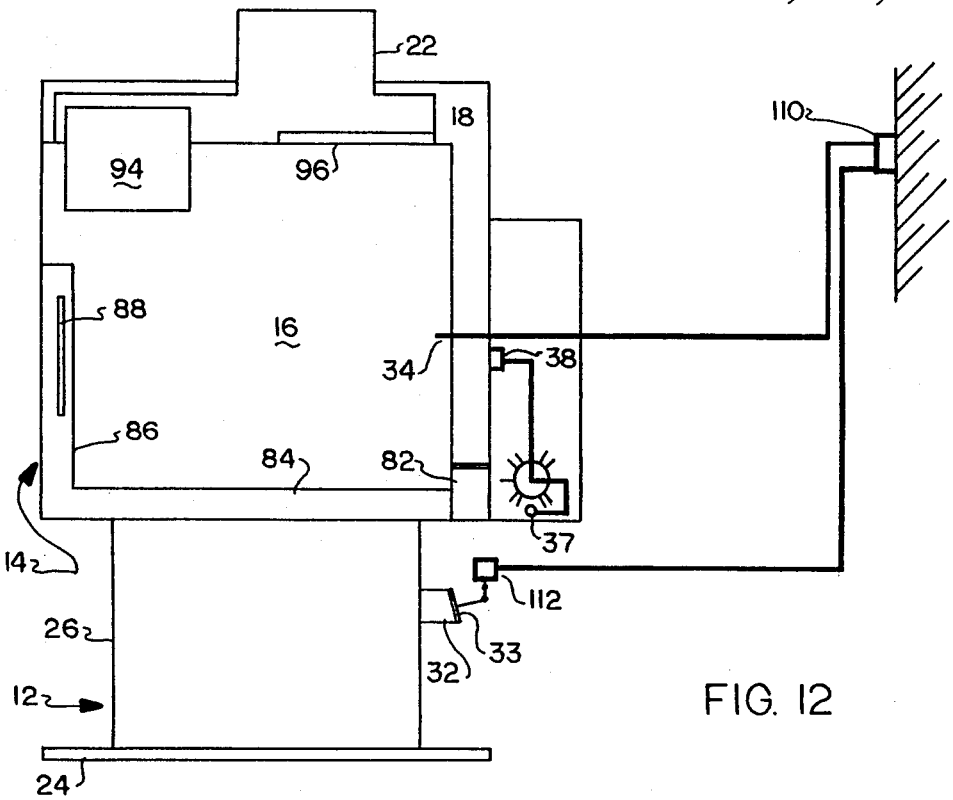
FIG. 12 is a schematic electrical diagram of the apparatus of this invention.

The electrical system which controls the operation of stove 10 is shown schematically in FIG. 12. Referring to FIG. 12, thermocouple 34 senses the temperature inside firebox 16 and communicates this information to microprocessor 110. Microprocessor 110 may be mounted in any desired location, for example on a wall in the house or room in which the stove 10 is located. Microprocessor 110 is preprogrammed to a finite number of firebox temperatures settings which enable the user of stove 10 to maintain a desired firebox temperature, and therefore a desired room temperature. The lowest temperature setting is typically 350° F.; temperature settings can go up to any desired level, for example about 950° F. for burning wood and up to about 1,600° F.–1,700° F. for burning anthracite. The user manually sets the desired temperature setting. When the firebox temperature exceeds the temperature for which microprocessor 110 is set, the microprocessor sends a signal to solenoid 112, causing the solenoid-operated primary air intake valve 33 to close. When the firebox temperature drops to more than a predetermined amount (say about 20° F. or approximately 10° C.) below the temperature for which microprocessor 110 has been set, this fact is communicated from thermocouple 34 to microprocessor 110, which sends a signal to solenoid 112 causing the primary air intake valve 33 to open. In this manner the temperature inside firebox 16 is maintained within a narrow range, regardless of the amount of wood in stove 10, unless the wood supply is nearly exhausted. This in turn maintains the room temperature close to a predetermined desired value. Microprocessor 110 may have an indicator light which comes on when the supply of wood in the firebox is no longer able to maintain the preset temperature.

Microprocessor 110 and its associated controls, e.g., thermocouple 34 and solenoid 112, are optional and are not preferred for coal burning stoves. The microprocessor and associated controls are highly desirable in wood burning stoves because they make it possible to control the burning rate more closely than is possible with manual controls, thereby improving fuel economy and minimizing fluctuations in temperature.

The speed of blower 36, which determines the rate at which air is circulated through air space 18, is controlled by manually operated blower seed control 37. A typical blower 36 has a capacity of 250 cubic feet per minute (CFM) and the output of the blower can be varied continuously over the entire range from zero to capacity. Thermostat 38 senses the air temperature in air space 18 by sensing the temperature of the wall between main housing 14 and blower housing 20, and causes blower 36 to shut down when the air temperature drops below a predetermined level.

One can control the temperature in the room or building in which stove 10 is situated by controlling the speed of blower 36, or the firebox temperature, or some combination of the two. An increase in blower speed will result in a warmer room temperature for any given outside weather condition and firebox temperature. Similarly, an increase in firebox temperature will result in warmer room temperatures if blower speed and outside weather conditions remain constant.

To use the stove 10, a supply of wood or other solid fuel is charged to the stove, the secondary air valve 82*a* is moved to full open position, the bypass damper 98 is opened, and a kindling fire is built in the firebox 16. Since the firebox temperature at this point is lower than any of the temperature settings provided on microprocessor 110, the primary air intake valve 33 is open so that both primary and secondary air are supplied to the stove. A mid-range temperature setting is preferred. In stoves which are not equipped with microprocessor 110, the manual primary air control knob 33*c* is opened to the desired setting. When the firebox has gotten somewhat warmer, the stove 10 is loaded with fuel (wood or coal) with bypass damper 98 open while loading. After loading a microprocess-equipped stove, the microprocessor 110 is set to the desired setting and bypass damper 98 is closed. In stoves not equipped with a microprocessor the bypass damper 98 is closed, the primary air control knob 33*c* is set to the desired rate of burn, and the secondary air valve 82*a* is slid out to the restricted opening position, in which closure member 82*b* and opening 82*a* are aligned with opening 80. As combustion continues, the firebox temperature increases until the temperature preset on microprocessor 110 is reached. At this time microprocessor 110, responding to a signal from thermocouple 34, shuts the primary air valve 33. Secondary air continues to be supplied to the firebox 16; however, the secondary air supply should be throttled back to the restricted opening position of slide valve 82 after about 45 minutes burning with full load. The supply of secondary air alone is sufficient to maintain complete combustion. Therefore complete combustion of fuel continues, but at a slower rate. If the firebox temperature drops by 20° F. below the preset level, the primary air intake valve 33 is again opened and remains open until the preset firebox temperature is reached once again. Both the firebox temperature and the heat output rate (e.g., BTU per hour) remain within a narrow range even though no further wood is added and the amount of wood in the stove becomes greatly diminished. The heat output rate will remain within plus or minus 5 percent of a constant value (assuming that both the present firebox temperature and the room temperature remain the same) until the stove is nearly out of fuel. When the fuel supply is nearly exhausted, the stove will no longer be able to maintain the preset firebox temperature, and a wood level indicator light on microprocessor 110 will come on. Even then, combustion of the remaining embers will continue until the amount of unburned fuel is no longer sufficient to sustain combustion.

The stove of this invention is the first wood burning stove, as far as applicant is aware, to achieve a substantially uniform heat output rate without being tended and without regard to the amount of fuel remaining in the stove. The preset stove also causes far less air pollution and is safer than previous wood stoves, because substantially complete combustion takes place so that products of incomplete combustion (creosote, for example) neither collect in the chimney nor are discharged into the atmosphere. The triple back wall construction (firebox back wall 62, wall 14*b* between main housing 14 and blower housing 20, and the outer wall of blower housing 20) and the double top wall construction (firebox top wall 60 and roof 46) are safety features which greatly decrease the risk of fire. In fact, the stove of this invention can be placed as close as 6½ inches to a building wall, and can be used in mobile homes, because of these wall constructions.

While in accordance with the patent statutes, a preferred embodiment and best mode has been presented, the scope of the invention is not limited thereto, but rather is measured by the scope of the attached claims.

What is claimed is:

1. A stove for burning solid fuels comprising:

a main housing having a top wall, a bottom wall having an opening for primary air therein, a plurality of vertical walls, and partition means dividing the interior of said housing into a firebox, a flue gas space above said firebox and an air space above and behind said firebox, said air space being in indirect heat exchange relationship with said firebox and said flue gas space;

means below said housing for supporting said housing;

said firebox having a grate near the bottom thereof and above said opening for primary air, and a charging door for admitting solid fuel, said charging door including at least one transparent panel;

said partition means including a generally horizontally extending partition forming the top wall of said firebox and having first and second openings therein for discharging flue gases, and a first vertical wall forming the back wall of said firebox;

a manually controlled damper for opening and closing said second opening;

means for admitting primary air to said firebox below said grate and passing said primary air upwardly through the grate;

means for admitting secondary air to said firebox on either side of said charging door and for directing said secondary air against the transparent panel of said charging door;

a variable opening valve controlling the flow of secondary air, said valve being open at all times, and a blower housing located behind said main housing, said blower housing having blower means therein for circulating air in said air space, said stove including a second vertical wall dividing said main housing from said blower housing, and a third vertical wall which forms the back wall of said blower housing.

2. A stove according to claim 1 in which said means for circulating air includes a variable speed blower.

3. A stove according to claim 1 in which said stove includes temperature responsive means including a microprocessor for controlling the admission of primary air, said temperature responsive means is responsive to firebox temperature.

4. A stove according to claim 3 in which said microprocessor can be preset to a plurality of firebox temperatures.

5. A stove according to claim 1 in which said first opening has a catalyst chamber containing an oxidation catalyst.

6. A stove according to claim 1 in which said charging door is on the front wall of said firebox.

7. A stove according to claim 1 including a valve for controlling the admission of primary air, and a manual control for said valve.

8. A stove according to claim 7 further including a solenoid for controlling said valve, and temperature responsive means for controlling said solenoid, said manual control being capable of overriding said solenoid.

9. A stove according to claim 1 further including sloping refractory lined channels on either side of said grate for supporting solid fuel.

* * * * *